United States Patent [19]

Johnson et al.

[11] Patent Number: 4,490,055

[45] Date of Patent: Dec. 25, 1984

[54] AUTOMATICALLY ADJUSTABLE DELAY FUNCTION FOR TIMED TYPAMATIC

[75] Inventors: Carl F. Johnson; James M. Williams, both of Lexington, Ky.

[73] Assignee: International Business Machines Corporation, Armonk, N.Y.

[21] Appl. No.: 393,928

[22] Filed: Jun. 30, 1982

[51] Int. Cl.[3] ..... B41J 5/28

[52] U.S. Cl. ..... 400/51; 400/704; 340/365 E

[58] Field of Search ..... 400/50, 51, 52, 321, 400/368, 369, 704, 70; 340/365 E, 365 S

[56] References Cited

U.S. PATENT DOCUMENTS

| | | | |
|---|---|---|---|
| 2,717,688 | 9/1955 | Brooks | 400/704 |
| 3,270,438 | 9/1966 | Ephraim | 400/704 X |
| 3,436,735 | 4/1969 | Hoiseth | 400/368 X |
| 3,618,034 | 11/1971 | Hecker | 400/51 X |
| 3,643,773 | 2/1972 | Holmes, Jr. | 400/50 X |
| 3,781,874 | 12/1973 | Jennings | 400/51 X |
| 3,973,662 | 8/1976 | Fulton | 400/50 X |
| 4,106,011 | 8/1978 | Melanson et al. | 340/365 E |
| 4,189,246 | 2/1980 | Kane et al. | 400/51 X |
| 4,263,582 | 4/1981 | Dumbovic | 340/365 S |
| 4,323,888 | 4/1982 | Cole | 400/368 X |

FOREIGN PATENT DOCUMENTS

| | | | |
|---|---|---|---|
| 1411549 | 10/1975 | United Kingdom | 400/51 |

OTHER PUBLICATIONS

IBM Technical Disclosure Bulletin, "Variable Time Delay for Hammer Firing in Rotating Disk-Type Printer", Balcezak et al., vol. 21, No. 12, May 1979, pp. 4759–4760.

IBM Technical Disclosure Bulletin, "Multiple Repeat Rates for a Terminal Keyboard", Leimer, vol. 23, No. 2, Jul. 1980, p. 770.

IBM Technical Disclosure Bulletin, "I/O Keyboard Switching of Keys from a Typamatic to a Non-Typamatic Status", Motola, vol. 24, No. 11B, Apr. 1982, p. 5859.

MCS-48 Microcomputer User's Manual, published 1978 by Intel Corporation, pp. 1-1-2-15.

*Primary Examiner*—Ernest T. Wright, Jr.

*Attorney, Agent, or Firm*—Laurence R. Letson

[57] ABSTRACT

A typewriter is described which has an electronic keyboard utilizing a timed delay to determine whether a depressed key is indicative of the desire to print or display repetitive letters represented by that key. The typewriter is provided with a technique for automatically adjusting the length of the delay such that a slow typist with sluggish finger movement will automatically cause the extension of the delay time and thereby prevent unwanted repetitive characters while a fast, very rhythmic typist will not cause the automatic extension of the delay time and thereby will benefit from a shorter delay time and will have a higher output or productivity as a result thereof.

The automatic extension is accomplished by timing the period of time that keylevers are held depressed and when that time approaches but does not exceed the preset automatic delay time, the delay time is then extended a predetermined amount.

11 Claims, 3 Drawing Figures

AUTOMATICALLY ADJUSTABLE DELAY FUNCTION FOR TIMED TYPAMATIC

BACKGROUND OF THE INVENTION

With the advent of electronic keyboards on terminals and typewriters, there has been a need for improving the operation of those keyboards to accomplish repeat characters. On mechanical keyboards which have the typamatic or repeat character capability, by holding the keybutton depressed to a second force level, the machine will repeatedly cycle and print repetitively the character indicated by the keybutton.

However, with keyboards using electrical or electronic contacts or a change in capacitance to indicate the depression of a keybutton for character selection, it is preferable to utilize an alternate technique of selecting repeated characters from the second depression force level approach.

With electronic keyboards, whether they be capacitance or switch arrangements, all the positions on the keyboard are scanned or sequentially queried to determine whether a keybutton has been depressed to select the character. One technique for repeating a character is the depression and release and redepression of the desired key. This approach will produce a plurality of identically repeated characters.

For keyboards having the repeat character characteristic, the keybutton may be held depressed and the processor which controls the scanning and other organizational functions of the keyboard, will detect the held-down condition and repeat the character automatically. This approach, although having many advantages, requires a timed delay after the depression of the keybutton before a second and subsequent cycles are initiated to insure that the typist has had an opportunity to remove the finger from the button and thereby not inadvertently initiate detection of the made or depressed condition indicating repetitive characters. This may be accomplished by requiring a timed delay of 500 or 600 milliseconds from the time that the first keybutton closing is sensed. If, after the predetermined delay time, the key is determined to be still held in a depressed condition, the processor assumes that repetitive characters are to be printed and initiates the appropriate printing cycles to form those characters on the record media, typically at machine cycle speed and continuing until such time as the keybutton is released and the keyboard processor detects the change of condition from a depressed key to a released key.

Typewriters and data processing terminals utilizing electronic keyboards and which are presently in the market utilize a fixed time delay, typically 600 milliseconds. This 600 millisecond delay is too long a period for a fast typist since a fast typist can typically key characters at an average rate of one character every 200 milliseconds or less. The net result of the 600 millisecond delay period is that a fast typist has their typing rhythm interrupted by virtue of having to stop and wait an additional 300–400 milliseconds for the repeat mode to begin to be initiated.

A shorter time delay is undesirable from the standpoint that a slow or sluggish typist will allow the fingers to rest on the keyboard keys and may inadvertently leave the key depressed for such a period of time as is necessary to initiate the repetitive printing or typamatic printing of a character.

Inasmuch as the operator or typist is unique in their timing, rhythm, speed and the length of time that a key is held depressed, it is not possible to provide a single timed delay which is acceptable or optimal for a great majority of the operators.

OBJECTS OF THE INVENTION

It is an object of this invention to adjust the delay and to lengthen the delay between the time a typamatic key is sensed as being depressed and the time that repetitive cycles are initiated under machine control.

It is another object of this invention to reduce erroneous typewriter inputs by sensing the typamatic keys and sensing the speed by which the keys are released and based thereon, adjusting the delay period.

It is still another object of the invention to increase typing accuracy on timed typamatic keyboards for slower typists by providing a longer period within which they may react to release a keybutton.

SUMMARY OF THE INVENTION

Electronic typewriters typically have keyboards which may be electronic in nature. If an electronic keyboard is implemented on a typewriter or, for that matter, an electronic data processing terminal, the keyboard is controlled by a processor which accepts signals from the keyboard responsive to a scan routine. The scanning of the keyboard is a technique for sequentially addressing each of keybutton positions and determining whether a circuit is complete through that keybutton position to indicate the operator having depressed the keybutton. In addition to the scanning or sequential interrogation of each key position to determine a change in the state of the switching device utilized, the keyboard processor is capable of performing timing functions. The keyboard processor can time the period that a particular selected keybutton or a group of keybuttons are held depressed.

For example, a single keybutton such as the space bar may be timed for each depression of the space bar or the keybuttons which are designated as typamatic or repeat character keys may be timed whenever any one of them is held depressed. If a typamatic key is held depressed for a period which is within 100 milliseconds of the preselected delay time, the keyboard processor automatically resets the delay time value to a next higher delay time unless the delay time is already at the maximum preselected value.

If the keybutton is still depressed and the switching element in the keyboard indicates that the circuit is made for that particular keybutton at the end of the timed delay period and that keybutton represents a typamatic character, the keyboard processor detects this condition and begins to repetitively output the character signal to the main typewriter or printer processor to cause the printing of that character at the printer machine rate.

Further, the adjustment of the delay time is supressed inasmuch as it is clear at the end of the delay period that the reason for continued depression of the key was to cause typamatic printing.

Release of the typamatic key prior to the end of the delay period will prevent any repeating characters. Additionally, the depression of any other key on the keyboard will be detected notwithstanding the continued depression of the typamatic key, and the depression of this other key during the time delay period will indicate a desire to subsequently print a second character and not enter the repeat mode and therefore will defeat the entry into the repeat mode notwithstanding the continued depression of the typamatic key.

If the typamatic mode of operation is entered after the time delay period, there will be no change in the delay time inasmuch as the long period of depression of a typamatic key is due to the desire for repetitive typing rather than due to sluggish typist action or slow removal of the finger from a typamatic key.

DRAWING

DESCRIPTION OF THE INVENTION

Figure 1:
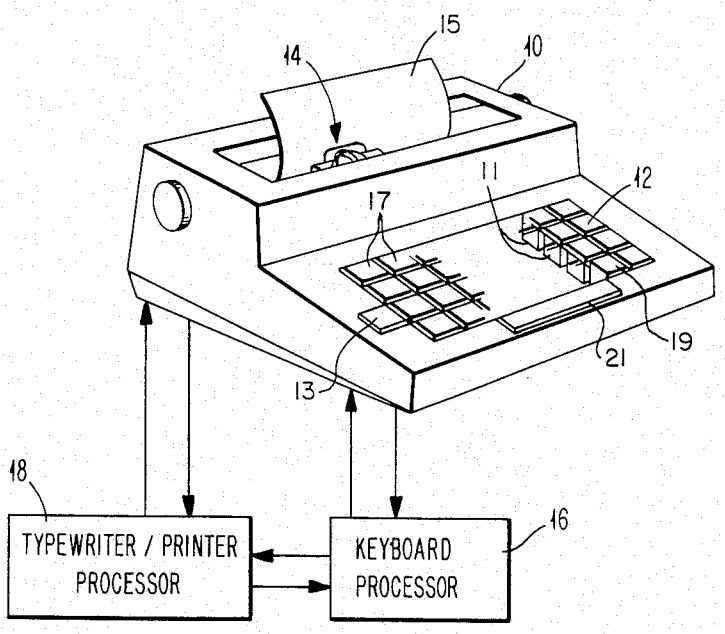
FIG. 1 illustrates a generalized system wherein a keyboard processor controls and receives signals from the keyboard and provides those signals to a main processor which, in turn, provides signals to the keyboard processor, to the printer and receives feedback signals from the printer.

For purposes of implementation and for purposes of describing this invention, a microprocessor sold under the designation Intel 8048 microprocessor sold by the Intel Corporation of Santa Clara, Calif., is used as the control of the electronic keyboard 12. Hereafter, the Intel 8048 microprocessor will be referred as the keyboard processor 16.

The Intel 8048 microprocessor is readily commercially available and the Intel Corporation provides manuals on its use indicating available register designations, available flags and their designations, and a list of instruction codes which may be utilized to cause the processor to function.

Additionally, the Intel 8048 has an eight bit timer which counts in response to clock pulses generated by the timing clock of the microprocessor 16 and will run through a complete 256 count timing sequence and overflow every 20.48 milliseconds (Msec).

The Intel 8048 processor, in addition to being readily available in the marketplace, is a conventional piece of electronic equipment widely used in many applications.

The architecture and operation of the Intel 8048 processor is described in the MCS-48 Microcomputer User's Manual, Copyright 1978, Intel Corporation, pages 1-1 through 2-16, which are incorporated herein by reference.

The Intel 8048 processor includes within its structure at least a clock, timer/event counter, registers, memory locations, read-only-memory and flags F0 and F1. These elements of the Intel 8048 processor are utilized to control the monitoring and altering of the timed delay of the typamatic function as it is more completely described below.

Figure 2:
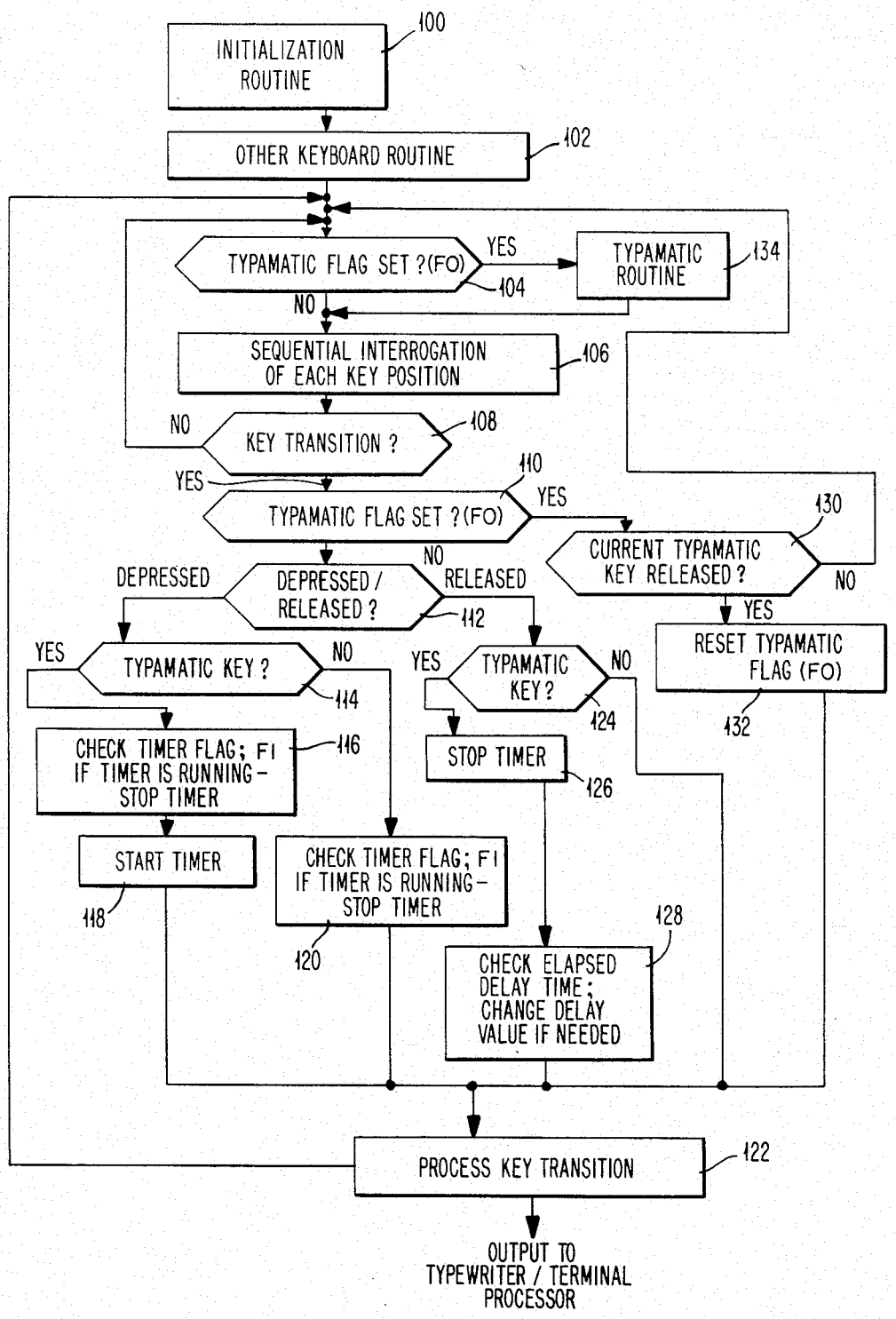
FIG. 2 is a flow diagram illustrating the flow of operations for carrying out the automated adjustment of the delay time for a timed typamatic keyboard.

Appendix A attached is a listing of instructions, statements and instruction codes and addresses which will control the keyboard processor 16 to perform the routines described in the flow diagram of FIG. 2.

While this system is described in connection with a typewriter 10, and utilizes the input from the typewriter keyboard 12, it should be recognized that this same typamatic adjustment of the delay may be implemented on any system which utilizes an electronic keyboard and which has typamatic keys and where the processor responds to a timed delay period after the first detection of the depression of a selected typamatic key to initiate subsequent printing cycles.

Printing cycle is used in the conventional term associated with typewriters, but it should be recognized that the displaying of a character on a display by means of illumination and electronic character generation may also be included within the terminology of printing.

Referring to FIG. 1, the typewriter 10 has a keyboard 12 associated therewith. In addition, typewriter 10 also has a printing assembly 14 capable of physically marking a record sheet 15 to display characters by any conventional typing or printing technology and the specifics of that portion of the device do not constitute part of the invention described herein. Keyboard processor 16 is the Intel 8048 microprocessor described above and is electronically connected to and interfaced with data lines leading to and from keyboard 12. The techniques of attaching these data lines to the keyboard processor 16 and the particular arrangement of keyboard 12 are conventional and do not constitute any portion of the invention.

Keyboard processor 16 is electronically interfaced with the typewriter/printer processor 18 hereinafter referred to as the printer processor 18. The printer processor 18 performs all the necessary control functions and determinations for operating the printing assembly 14 of the typewriter 10 to cause the printing of characters. Printer processor 18 sends control signals to the printing assembly 14 and receives the necessary feedback signals from the printing assembly 14 to maintain control of the printing assembly 14 in an appropriate sequence. Printer processor 18 receives character signals and other necessary control signals from the keyboard processor 16 and provides feedback to keyboard processor 16. The keyboard processor 16 likewise has two-way connections to the keyboard 12 to provide signals to the keyboard 12 for purposes of scanning the keyboard 12 and a return path for signals from the keybutton switching elements 11 in keyboard 12 such that the signals generated thereby may be transmitted to the keyboard processor 16.

Referring to FIG. 2, the initialization routine in block 100 accomplishes the loading of preset information into designated registers R0, R3–R7 within the processor 16 when the processor 16 and typewriter 10 are initially turned on. This information is permanently stored in non-volatile read only memory locations within the keyboard processor 16 and is not changeable type of information.

The information loaded into the respective registers with their initial values are set forth below by way of illustration and not by way of limitation.

| Register Designation | Description of or Information Contained in the Register |
|---|---|
| R0 | Pointer to cause the addressing of selected registers R20–R29 |
| R2 | Timer overflow count |
| R3 | Fractional delay value |
| R4 | Whole portion current delay value |
| R5 | Fractional portion current delay value |
| R7 | Status Register |
| R20 | 9 |
| R21 | 61 |
| R22 | 14 |
| R23 | 90 |

-continued

| Register Designation | Description of or Information Contained in the Register |
|---|---|
| R24 | 19 |
| R25 | 120 |
| R26 | 24 |
| R27 | 151 |
| R28 | 29 |
| R29 | 180 |

With the initializing of the registers R0–R29 as indicated herein, the timing delays are stored such that they are accessible by the processor 16 not in terms of actual time delay but, rather, in terms of complete timer cycles which require 20.48 Msec per timer cycle. The tabulation below indicates a time period delay and the number of whole timer cycles and a value which, when loaded into the timer, will result in a fractional timer cycle very closely approximating the desired time and which correlate to the initialization values of registers R20–R29 above.

| | Whole Cycles | Fractional Cycle |
|---|---|---|
| 200 Msec | 9 | 11 61 |
| 300 Msec | 14 | 90 |
| 400 Msec | 19 | 120 |
| 500 Msec | 24 | 151 |
| 600 Msec | 29 | 180 |

The timer is a 256 cycle or an eight bit timer which operates on the 80 microsecond clock pulse period thus resulting in a complete timer cycle from 0 to 256 in 20.48 milliseconds. Thus, to get a 200 millisecond delay will require a total of nine complete timer cycles and 0.76 fractional timer cycle. In order to operate the timer within its operational constraints, an initial fractional value is loaded into the timer from which the timer will then count upward to its capacity of 256. Thus, a value loaded into the timer cycle is the portion of the timer cycle not required and, thus, represents a starting point for the timer to count upwardly from. To determine the fractional amount to be loaded into the timer, the equation $[20.48-0.76(20.48)]/0.08=61$ is illustrative of how the fractional value for a 200 millisecond time delay is determined. The 20.48 is representative of the time required for a complete timer cycle and 0.76 represents the fractional portion of a timer cycle required in addition to the complete timer cycle for the desired time delay.

Similar calculations may be performed to arrive at the whole or fractional number values for the registers R20 and R29 for each of the predetermined time delays. For each of the predetermined time delays, two registers have been dedicated to storing the numbers and, thus, they are available to the processor 16 to update the time delay when appropriate.

Again, referring to FIG. 2, after the initialization procedure and the initializing of the typamatic flag F0 and timer flag F1 to an unset condition, the sequence of events portrayed by the flow diagram may proceed. It should be noted that flag F0 and F1 are arbitrary flags which may be used and their use is available to the designer for any purpose desired and may be set and reset as desired under instruction control. These flags F0, F1 are provided in the Intel 8048 used as the keyboard processor 16.

After the initialization routine is accomplished (block 100), other keyboard routines not germaine to this invention are performed by the keyboard microprocessor 16 (block 102) and, by way of illustration, include the checking of the code key 13 on a typewriter keyboard 12 to determine whether it has been depressed signaling a command other than a character selection when combined with a character key depression. Additionally, a check of the printer feedback signal from the printer processor 18 may be made at this time to maintain the keyboard processor 16 in synchronization with the printer processor 18 and the printer assembly 14.

The flow then proceeds to block 104 wherein a decision is made as to whether the typamatic flag F0 is set. Initially, the typamatic flag F0 has been initialized in the initialization routine in block 100 in an unset condition and, therefore, the flow proceeds through the "No" path to the sequential interrogation of key position subroutine in block 106. In electronic keyboards, the keyboard processor 16 sequentially addresses the matrix of keyboard switching elements 11 to determine which, if any, have been caused to create a transition from a make to a break or from a break to a make condition. As a result of this sequential interrogation, the flow proceeds to block 108 wherein a decision is made as to whether a key transition from a break to a make or make to a break has occurred in the keyboard 12. If no transition has occurred, then the flow returns by the path indicated and reenters the decision block 104 to determine whether the typamatic flag has been set. This loop continues until such time as a key transition has been detected and such a decision has been made that a transition occurred in decision block 108.

Upon the detecting of a key transition, the flow proceeds from block 108 to block 110 wherein the typamatic question is posed "Has the typamatic flag been set?" If the typamatic flag F0 has not been set, the processor flow proceeds through the no path to decision block 112 which determines whether the key transition determined in block 108 was a depression or a release. If the transition was a depression of the key, then the path goes to the decision block 114 where the determination is made as to whether the key which ransitioned was a typamatic key such as a period 19 or space 21 key and if the key was a typamatic key 19, 21 then the flow path goes by the yes route to check the timer flag F1 and if the timer is running, to stop the timer as indicated in subroutine block 116. This condition is a condition which may exist if the typamatic key 19, 21 just depressed was the second consecutive typamatic key 19, 21.

Upon the completion of stopping the timer, it will have the effect of initializing the timer and the timer is then restarted in block 118. By stopping the timer and restarting the timer, this insures that the time delay period being considered is applicable only to the most recent typamatic key 19, 21 and effectively removes the possibility of inadvertently typing repeat characters from a former typamatic key 19, 21 when it is clear by the depression of a subsequent key that the operator does not desire to enter the typamatic mode on the earlier key depression.

Returning to decision block 114, if the determination is that the key transition was a depression and that it was not a typamatic key 19, 21, then if the timer flag F1 is set and thus the timer is running, the timer is stopped as indicated in block 120. This insures that any previous typamatic key 19, 21 which remains depressed does not trigger subsequent repeat characters.

Upon the completion of either the restarting of the timer in block 118 or the stopping of the timer in block 120, the key transition is processed and an output is generated to the typewriter printer processor 18 to accomplish printing of the selected character in accordance with the other keyboard routines and the flow returns from the key transition processing block 122 back to enter block 104 for the next cycle.

Referring back now to decision block 112 where the determination was made as to whether a key transition with no typamatic flag F0 set was a depression or a release and where the decision was that the transition was a release, the determination is then made as to whether the key 17, 19, 21 released was a typamatic key in decision block 124. The purpose of this is to accommodate the stopping of the timer upon the release of the key (Block 126).

If the key 17, 19, 21 was a typamatic key, then the stop timer routine (block 126) is the next function of the processor 16 and the time elapsed determined in block 128. If the time elapsed is within approximately 100 milliseconds of the current delay time, then the subroutine represented by block 128 will change the delay value to the next larger predetermined delay value as represented in registers R22–R29. The check of the time is effectively accomplished by checking the value in register R2 and comparing it with a preset numerical value of 5. If it is equal to or less than 5, the typamatic 19, 21 key has been held down to within approximately 100 milliseconds of the current delay time and the subroutine will make the desired change in the delay time value.

After the completion of making such a change, the key transition is processed and in this case would not initiate a character. The key transition processing is accomplished in block 122.

Referring back to the decision in block 124 as to whether the released key 17, 19, 21 was a typamatic key and with a "NO" response to that determination, then the next step is the processing of key transition 122.

Returning to decision block 110 wherein a determination is made upon a key transition as to whether the typamatic flag F0 has been set and where the flag F0 has been set, the decisional flow will be to decision block 130 where a determination is made as to whether the current typamatic key 19, 21 has been released. In the event that the current typamatic key 19, 21 has not been released, the flow returns to reenter block 104. In the event that the current typamatic key 19, 21 has been released (block 130), then the typamatic flag F0 is reset by the subroutine represented by block 132 and then the key transition is processed by block 122.

In decision block 130, there is a check procedure performed to determine whether the current typamatic key 19, 21 has been released. This check compares the last key transition address or the key location designation on the keyboard 12 which last indicated a key transition with the current typamatic key address to determine if the current typamatic key 19, 21 was the one released. If the transition indicated as a release is not the current typamatic key 19, 21, then there is continued scanning of the keyboard 12 by reentering at a point upstream from block 104. When the current typamatic key is released (Block 130) and there is a compare between the last key transition address and the current typamatic key address, then the flow follows the YES path to block 132.

Figure 3:
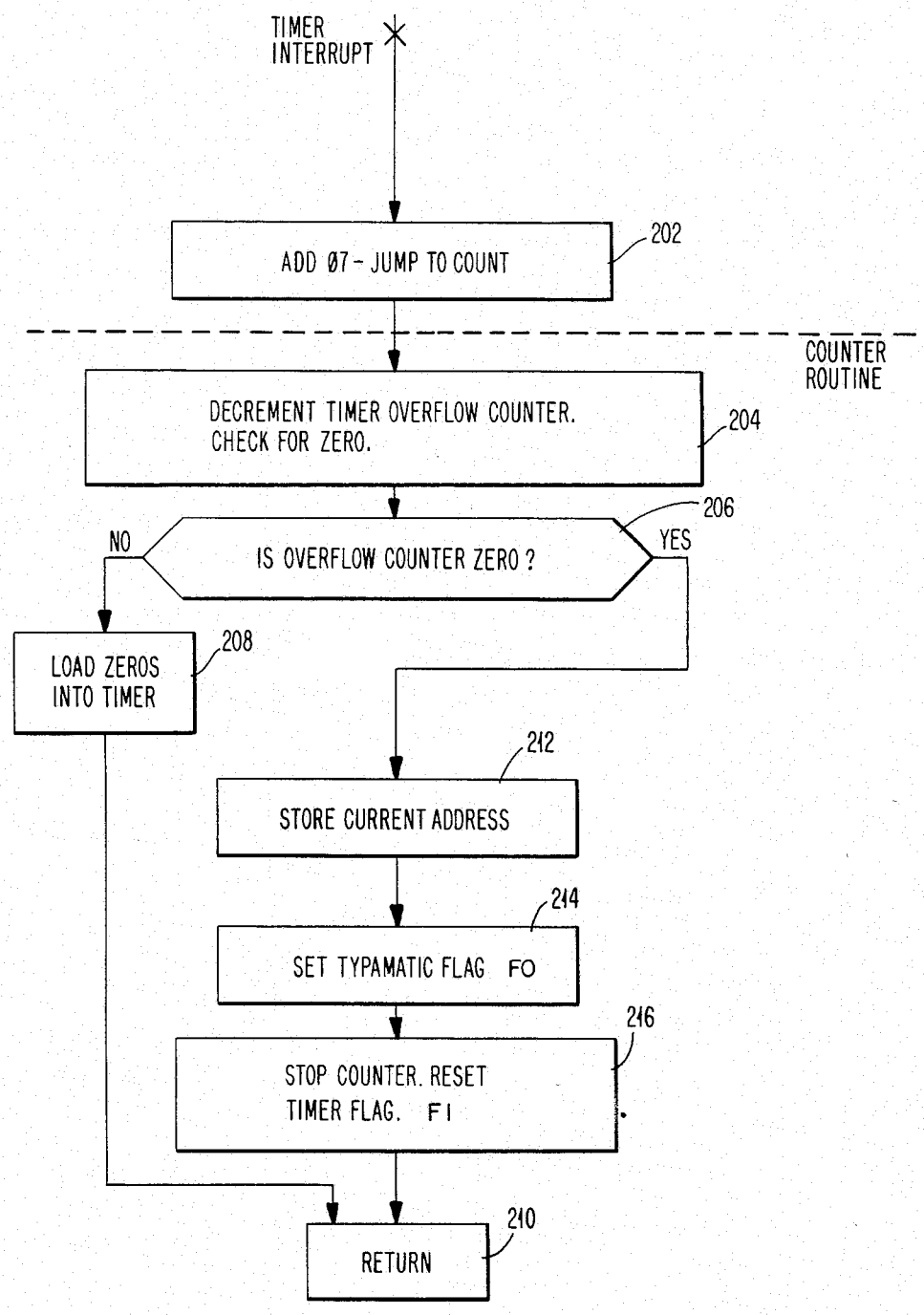
FIG. 3 is a flow diagram illustrating the flow within the timer interrupt routine.

Referring to FIG. 3, the flow of the timer interrupt routine is illustrated. For best understanding, the timer portion of the processor 16 continues to operate simultaneous with other functions of the processor 16 performing the flow illustrated in FIG. 2. Every time the timer of the processor 16 reaches a condition where all bits are "1", that is indicated as an overflow condition and a timer interrupt signal emits from that portion of the processor 16 to interrupt the sequence of operations in the flow of FIG. 2. As dictated by the construction of the Intel 8048 processor, utilized as the keyboard processor 16, any time there is a timer overflow condition initiating a timer interrupt command, the processor 16 immediately goes to address 07 which is a jump to count routine instruction. This is illustrated at block 202. From the jump to count instruction stored in address 07 (block 202), the count routine is entered to effect the counting in register R2 for keeping track of the time delay. Upon the receipt of a timer interrupt command and the processing of the jump to count instruction (block 202), the timer overflow count (register R2) is decremented by one and a check to see if the timer overflow count is now zero (block 204).

If the overflow counter contents is not zero, then the flow follows the NO path from block 206 where that decision is made to block 208 where a routine directs that zeros are loaded into the timer. As soon as the zeros are loaded into the timer as commanded by subroutine indicated at block 208, the timer will immediately begin counting in response to the timing pulses of the keyboard processor clock.

Thereupon, the flow goes to return block 210. Upon entering the return routine (block 210), the processor 16 returns to the flow in FIG. 2 at precisely the point it was when the interrupt command was issued by the timer. The flow of FIG. 2 then continues uninterrupted until such time as a subsequent timer interrupt command issues upon a timer overflow condition.

Referring back to block 206, if the overflow counter contains a zero after the decrementing in block 204, the YES path is followed and the current address of the key position which has been held depressed throughout the entire period of time that the timer was overflowing a sufficient number of times to decrement the timer overflow counter to zero, is stored (block 212). This address will be utilized by the main flow in FIG. 2, specifically block 130, during a check routine to determine subsequently when that typamatic key 19, 21 is released.

After the storage of the typamatic key address (block 212), the typamatic flag F0 is then set (block 214) and the counter is stopped. This effectively prevents the timer from continuing to time inasmuch as there is no need to do so until either the typamatic key 19, 21 has been released or another typamatic key 19, 21 has been depressed. This operation is represented by block 216.

At the same time, the timer flag F1 is reset to a zero condition indicating that the timer is not functioning. At this point, the flow goes to return (block 210) wherein the main flow of FIG. 2 is reentered at the precise point that the timer interrupt occurred and the process illustrated by the flow diagram in FIG. 2 continues uninterrupted until interrupted by another interrupt command.

The rectangular blocks in the above routine represent subroutines which are performed under a series of instructions contained in the read-only-storage portion of processor 16. The sequential interrogation of each key position in block 106, the other keyboard routines in block 102 and the processing of the key transition 122 have not been listed in Appendix A inasmuch as they are conventional routines which can be found in electronic keyboards presently on the market, for example, in the IBM 6240 keyboad manufactured and sold by the International Business Machines Corporation, Armonk, N.Y. The routines enumerated in Appendix A involve some aspect or significantly add to the understanding of the invention herein and, therefore, are included.

Appendix A has a code listing of instructions set forth using conventional notation and is grasped into five columns, Location, Program Code, Label, Nmemonics and Comments.

The routine in block 134 is the routine which controls the output of characters in the repeat mode. It checks the printer feedback signals to determine when the printer is ready for the next character.

The sequential interrogation (block 106) is a routine which is dictated by the type of keyboard used, such as conductive, capacitive or membrane.

In conjunction with the interrogation controls, a register is used to store indicators of status in bits 0, 1 and 2 and are designated:

Bit 0—typamatic bit, 1-typamatic, Ø not typamatic
Bit 1—key transition bit, 1-transition, Ø no transition
Bit 2—key depressed/released, 1-depressed, Ø released The interrogation routine determines (1) if the key position is typamatic and sets bit Ø, (2) if the key 17, 19, 21 is up or down, (3) if key transition has occurred and sets bit 1, and (4) if the key 17, 19, 21 has been released or depressed (bit 2). The processing of the key transition (block 122) controls output of data to the printer/typewriter processor 18 and controls the scanning of the keyboard 12.

Specific examples of these routines will not aid in understanding the invention and are not part thereof.

By adjusting the time delay through which an operator must hold a typamatic key 19, 21 depressed in order to get repetitive character printing, the slow typist will automatically with a minimum of errors, cause the adjustment of the time delay typically within three or four typamatic key cycles, to a value which will insure that the typamatic characters are only printed when desired and which will also accommodate a slow or sluggish keystroke. This adjustment will occur very rapidly after the typewriter 10 is turned on and typing commences inasmuch as the spacebar 21 and period key 19 are both typically typamatic keys with a relatively high degree of usage. Thus, a slow typist who tends to linger on the keybutton will, of necessity, condition the typewriter 10 within a very, very few keystrokes on either of these keys 19, 21 to extend the delay time.

A typist with a fast and very rhythmic stroke will not adjust the time delay as rapidly and therefore will be able to avail the typist of a shorter delay time for any intentional typamatic characters.

APPENDIX A

| LOCATION | PROGRAM CODE | LABEL | NMEMONICS | COMMENTS |
|---|---|---|---|---|
| 0 | | | | |
| 1 | | | | |
| 2 | | | | |
| 3 | | | | |
| 4 | | | | |
| 5 | | | | |
| 6 | | | | |

APPENDIX A-continued

| LOCATION | PROGRAM CODE | LABEL | NMEMONICS | COMMENTS |
|---|---|---|---|---|
| 7 | Ø4 | | Jmp Count | Timer Interrupt Pointer |
| 8 | 9A | | | |
| 9 | | | | |
| A | | | | |
| B | | | | |
| C | | | | |
| D | [Following is part of an initialization routine.] | | | |
| E | | | | |
| F | | | | |
| 1Ø | Ø5 | | ENI | Enable Timer Interrupt |
| 11 | 85 | | CLR FØ | Reset Typamatic Flag |
| 12 | A5 | | CLR F1 | Reset Timer Flag |
| 13 | B8 | | Mov RØ, H2Ø | Initialize Pointer |
| 14 | 2Ø | | | |
| 15 | 14 | | Call load delay | Places current delay value in R4 and R5 |
| 16 | 6Ø | | | |
| 17 | | | | |
| 18 | | | | |
| 19 | [Other keyboard routines located here.] | | | |
| 1A | | | | |
| 1B | | | | |
| 1C | | | | |
| 1D | | | | |
| 1E | | | | |
| 1F | | | | |
| 2Ø | B6 | P1 | JFØPØ | Jump if Typamatic Flag is Set |
| 21 | 24 | | | |
| 22 | Ø4 | | Jmp P2 | |
| 23 | 26 | | | |
| 24 | 14 | PØ | Call Typamatic | |
| 25 | — | | | |
| 26 | 14 | P2 | Call Interrogate | |
| 27 | — | | | |
| 28 | FF | | Mov A, R7 | Get Index or Register |
| 29 | 32 | | JB1, P3 | Check for key transition |
| 2A | 2D | | | |
| 2B | Ø4 | | Jmp, P1 | No transition, go to beginning |
| 2C | 20 | | | |
| 2D | 12 | P3 | JBØ, P4 | Jump if in typamatic mode |
| 2E | 31 | | | |
| 2F | Ø4 | | Jmp, P5 | |
| 30 | 36 | | | |
| 31 | 14 | P4 | Call check | |
| 32 | — | | | |
| 33 | 95 | | CPL FØ | Reset typamatic flag |
| 34 | Ø4 | | Jmp, P6 | Jump to Process key transition |
| 35 | 52 | | | |
| 36 | 52 | P5 | JB2, P7 | Jump if key depressed |
| 37 | 40 | | | |
| 38 | 12 | | JBØ, P8 | Jump if key is typamatic |
| 39 | 3C | | | |
| 3A | Ø4 | | Jmp, P6 | Jump to Process key Transition |
| 3B | 52 | | | |

APPENDIX A-continued

| LOCATION | PROGRAM CODE | LABEL | NMEMONICS | COMMENTS |
|---|---|---|---|---|
| 3C | 14 | P8 | Call stop timer | |
| 3D | 89 | | | |
| 3E | Ø4 | | Jmp, P6 | Jump to Process key Transition |
| 3F | 52 | | | |
| 40 | 12 | P7 | Jmp, P9 | Jump if key is typamatic |
| 41 | 4A | | | |
| 42 | Ø4 | | JF1, P10 | Jump if timer running |
| 43 | 46 | | | |
| 44 | Ø4 | | Jmp, P6 | Jump to Process key Transitions |
| 45 | 52 | | | |
| 46 | 14 | P1Ø | Call stop timer | |
| 47 | 89 | | | |
| 48 | Ø4 | | Jmp, P6 | Jump to Process key Transitions |
| 49 | 52 | | | |
| 4A | Ø4 | | Jmp, P11 | Jump if timer running |
| 4B | 4E | | | |
| 4C | Ø4 | | Jmp, P12 | |
| 4D | 50 | | | |
| 4E | 14 | P11 | Call stop timer | |
| 4F | 89 | | | |
| 50 | 14 | P12 | Call start timer | |
| 51 | 7A | | | |
| 52 | 14 | P6 | Call Process Key Transition | |
| 53 | — | | | |
| 54 | Ø4 | | Jmp, P1 | Jump to beginning |
| 55 | 2Ø | | | |
| 56 | | | | |
| 57 | | | | |
| 58 | | | | |
| 59 | | | | |
| 5A | | | | |
| 5B | | | | |
| 5C | | | | |
| 5D | | | | |
| 5E | | | | |
| 5F | | | | |
| 6Ø | FØ | Load Delay | Mov A@RØ | Gets delay values using pointer and puts them in R4 and R5. |
| 61 | AC | | Mov R4,A | |
| 62 | 18 | | INC RØ | |
| 63 | FØ | | Mov A@RØ | |
| 64 | AD | | Mov R5,A | |
| 65 | 83 | | Ret | |
| 66 | | | | |
| 67 | | | | |
| 68 | | | | |
| 69 | | | | |
| 6A | FC | Increase dly | Mov A, R4 | If stop timer routine indicates that a new delay value is needed, this routine will increment RØ pointer and call load delay. |
| 6B | D3 | | XRLA, H29 | |
| 6C | 29 | | | |
| 6D | C6 | | JZ, Delay 1 | |
| 6E | 72 | | | |
| 6F | 18 | | INC RØ | |
| 7Ø | 14 | | Call load delay | |
| 71 | 6Ø | | | |
| 72 | 83 | Delay 1 | RET | |

APPENDIX A-continued

| LOCATION | PROGRAM CODE | LABEL | NMEMONICS | COMMENTS |
|---|---|---|---|---|
| 73 | | | | |
| 74 | | | | |
| 75 | | | | |
| 76 | | | | |
| 77 | | | | |
| 78 | | | | |
| 79 | | | | |
| 7A | FC | Start Timer | Mov A, R4 | Move whole value to R2 |
| 7B | AA | | Mov R2, A | |
| 7C | FD | | Mov A, R5 | Move fractional value to R3 |
| 7D | AB | | Mov R3, A | |
| 7E | 62 | | Mov T, A | Load fractional value into timer |
| 7F | 55 | | Start T | Start timer |
| 8Ø | B5 | | CPL F1 | Set timer flag |
| 81 | 83 | | RET | |
| 82 | | | | |
| 83 | | | | |
| 84 | | | | |
| 85 | | | | |
| 86 | | | | |
| 87 | | | | |
| 88 | | | | |
| 89 | 65 | Stop timer | Stop tent | Stop timer |
| 8A | B5 | | Cpl F1 | Reset timer flag |
| 8B | FA | | Mov A, R2 | Check if remaining time less than 100 msec |
| 8C | 37 | | Cpl A | |
| 8D | Ø3 | | Add A, HØ5 | |
| 8E | Ø5 | | | |
| 8F | F6 | | JC, increase delay | Jump if carry set (remaining time less than 100 msec |
| 9Ø | 6A | | | |
| 91 | 83 | | RET | |
| 92 | | | | |
| 93 | | | | |
| 94 | | | | |
| 95 | | | | |
| 96 | | | | |
| 97 | | | | |
| 98 | | | | |
| 99 | | | | |
| 9A | EA | | DJNZ R2, Count 1 | |
| 9B | A5 | | | |
| 9C | | | | Reserved for code to store current key address. |
| 9D | | | | |
| 9E | | | | |
| 9F | | | | |
| AØ | 95 | | Cpl FØ | Sets typamatic flag |
| A1 | 65 | | Stop tent | Stop timer |
| A2 | B5 | | Cpl F1 | Reset timer flag |
| A3 | Ø4 | | Jmp, Count 2 | |
| A4 | A7 | | | |
| A5 | 27 | Count 1 | Clr A | Load zeros into timer |
| A6 | 62 | | Mov T, A | |
| A7 | 93 | Count 2 | RETR | |
| A8 | | | | |
| A9 | | | | |
| AA | | | | |
| AB | | | | |
| AC | | | | |
| AD | | | | |
| AE | | | | |

APPENDIX A-continued

| LO-CA-TION | PRO-GRAM CODE | LA-BEL | NMEMONICS | COMMENTS |
|---|---|---|---|---|
| AF | | | | |

We claim:

1. A method of controlling the sensing time period for detecting a condition indicative of a desire for a character to be repetitively displayed comprising:

providing a preset sensing time period, the exceeding of which by the depression of a single character key is indicative of a repetitive display operation;

measuring the period of time that a selected control key is depressed;

comparing said period of time with a predetermined standard time period;

increasing said sensing time period when said period of time exceeds said standard time period, whereby an operator who is slow and holds keys depressed for a longer period of time than normal will not undesirably display multiple characters.

2. The method of claim 1 wherein increasing said sensing time period comprises selecting one of a plurality of varying sized sensing time periods.

3. The method of controllably changing the time period a key of a keyboard must be maintained depressed to initiate repetitive character display or function operation comprising:

providing a keyboard capable of electronically sensing key depression;

providing a first predetermined time period;

determining the period of time a key on said keyboard is depressed;

determining if said period of time is less than but within a predetermined amount of said predetermined time period, and if within said predetermined amount;

adjusting said predetermined time period to a longer predetermined time period, thereby lengthening the time period a key must be held depressed to initiate repetitive character display or function operation when a key is held depressed, a period approaching said predetermined time period but insufficiently long to cause said repetitive character display or function operation.

4. The method of claim 3 wherein said adjusting comprises:

providing a plurality of selected time periods and selecting the next larger of said time periods and substituting said next larger of said time periods for said first predetermined time period.

5. A character displaying apparatus having a keyboard capable of at least some repetitive character and function selection through key depression for a prolonged period of time comprising:

means for detecting key depression and release, means for timing the period between key depression and key release, means for comparing said period with said prolonged period, means for initiating repetitive character or function selection when said period exceeds said prolonged period, and means for increasing said prolonged period when said period is within a predetermined amount of time of said prolonged period, thereby automatically sensing a sluggish typist and increasing the prolonged period a key must be held depressed to cause repetitive character or function selection.

6. The apparatus of claim 5 wherein said means for increasing comprises a timer overflow counter and means for selecting predetermined values for use in said timer overflow counter.

7. The apparatus of claim 5 wherein said means for timing comprises a timer counter of fixed capacity which overflows when counted to capacity, and said means for comparing comprises a timer overflow counter for accounting for timer overflow events.

8. The apparatus of claim 5 wherein said means for timing is operatively associated with selected keys on said keyboard.

9. The apparatus of claim 8 wherein said selected keys comprise a space key and a period key.

10. The apparatus of claim 5 wherein said apparatus having said keyboard is a typewriter.

11. The apparatus of claim 5 wherein said repetitive character selection comprises repetitive printing of said character.

* * * * *